United States Patent [19]

Mazzolla

[11] 3,950,867

[45] Apr. 20, 1976

[54] REFLECTOR SHEET AND PAD FOR IRONER ROLL

[76] Inventor: Dan D. Mazzolla, 2464 Raleigh Drive, York, Pa. 17402

[22] Filed: July 23, 1975

[21] Appl. No.: 598,804

[52] U.S. Cl. ..... 38/66

[51] Int. Cl.[2] ..... D06F 71/36

[58] Field of Search ..... 38/66, 44–62, 38/140, 8, 14; 68/5 D, 6–8

[56] References Cited

UNITED STATES PATENTS

| | | | |
|---|---|---|---|
| 1,689,462 | 10/1928 | Trotler et al. | 38/57 |
| 3,681,865 | 8/1972 | McMillan | 38/56 |
| 3,878,627 | 4/1975 | Mazzolla | 38/56 |

*Primary Examiner*—George V. Larkin
*Attorney, Agent, or Firm*—C. Hercus Just; Samuel M. Learned, Jr.

[57] ABSTRACT

An ironing roll reflector, pad, and cover means adapted to be mounted upon vacuum cylinders of industrial type ironing machines and having, as respective components in the preferred embodiment thereof; a sheet of heat reflective material provided with a plurality of perforations therein and having one end affixed to the cylinder and circumferentially wrapped around the cylinder so that the plurality of perforations therein communicate with the openings provided in the cylinder: a second component comprised of a resilient porous pad member directly overlying said heat reflective sheet and having one end thereof affixed to said cylinder coincident with affixed end of said reflective sheet circumferentially wrapped around said heat reflective perforated sheet member to form a single thickness of resilient padding upon the cylinder; and a porous fabric cover member having one end thereof affixed to the free terminal end of said resilient porous pad member and also circumferentially wrapped about the pad member to form a multiple-thickness protective cover means for the entire ironing roll reflector and pad means components which as combined parts comprise the present invention.

5 Claims, 4 Drawing Figures

REFLECTOR SHEET AND PAD FOR IRONER ROLL

BACKGROUND OF THE INVENTION

Industrial rotatable cylinder ironing machines, as exemplified and discussed in U.S. Pat. No. 3,151,408 to Mazzolla, the instant applicant, have long been utilized in large scale industrial, commercial, and institutional laundry operations for the purpose of ironing bed linens, table cloths, towels, various articles of clothing such as uniforms or other garments, and the like. Although not specifically shown in the aforementioned patent to Mazzolla, the ironing cylinders of such machines may be equipped with vacuum means to further increase ironer efficiency by providing a reduced pressure environment in the ironing area of the machine so that when a water-damp work piece is passed between the vacuum cylinder and the chest of the ironer the heating effect of the ironer will more readily cause vaporization of the water as well as providing an effective means to withdraw and exhaust the water vapor away from the ironing area.

In order to effectively utilize the increased ironing efficiency capability provided by a vacuum cylinder ironing machine, it is necessary that the vacuum not only be operable within the cylinder shell, but also through the openings provided therein as well as through the cylinder pad and cover members to produce a reduced pressure environment in the ironing area of the machine.

The disclosure set forth in U.S. Pat. No. 1,468,557 to Cline, dated Sept. 18, 1923, teaches a rather complicated compressive type spring arrangement affixed to the surface of an ironing machine vacuum cylinder over which springs is wrapped a layer of wire gauze being thereafter covered by a layer of fabric padding around which is wrapped a woven fabric covering. There are no provisions, however, for heat reflective means about the cylinder surface, nor is the pad means disclosed in the patent to Cline of a type which would operationally enable an effective transmission of vacuum through said pad to the ironing area.

In another disclosure, as taught by U.S. Pat. No. 2,608,749 to Obitz, dated Sept. 2, 1952, there is shown an ironer pad which is provided with heat-reflecting means, but, however, the same is not adapted to be employed upon a vacuum cylinder.

It will become apparent, as hereinafter set forth and claimed, that the present invention is distinguishable from the disclosures heretofore cited in that the present invention has utility features and use characteristics which provide new and useful advantages and improvements neither taught nor anticipated by such prior art.

SUMMARY OF THE INVENTION

It is the principal object of the present invention to provide an ironing roll reflector, pad, and cover means assembly for respective installation upon the vacuum cylinder members of an industrial ironing machine, whereupon installation of said assembly serves to furnish a protective heat reflective cylinder covering thereby resulting in an increased thermal efficiency of said machine due to reduced radiant, convective, and conductive heat losses through said cylinders, in addition to reducing cylinder surface exposure to the corrosive effects of steam released from water-damp work pieces during the ironing process, which steam contains entrained cleaning component residues wherein the same would otherwise normally be in constant contact with the metal surfaces of said cylinders.

Yet another object of the present invention is to provide an ironing roll reflector, pad, and cover means assembly wherein the reflector member thereof reflectively re-directs heat from the vacuum cylinder surface back toward the ironer steam chest, thereby helping to maintain said pad member in a relatively dry condition during ironing operations with a consequent additional increase in ironer efficiency.

It is another object to provide an ironing roll reflector, pad, and cover means assembly which incorporates a compressible pad member and thereby furnishes a yieldable surface upon the face of said cylinders which in turn enables the ironing of garments and other fabric work pieces having buttons and bulky seams without the danger of breaking said buttons or damaging the work piece or cover member or steam chest contact surface of said machine due to the compressible characteristics of said pad member.

It is a further object to provide a relatively inexpensive ironing roll reflector, pad, and cover means assembly which may be easily and quickly installed by persons not possessed of either special skills or training.

Details of the foregoing objects and of the invention, as well as other objects thereof, are set forth in the following specification and illustrated in the accompanying drawings comprising a part thereof.

DETAILED DESCRIPTION

Figure 1:
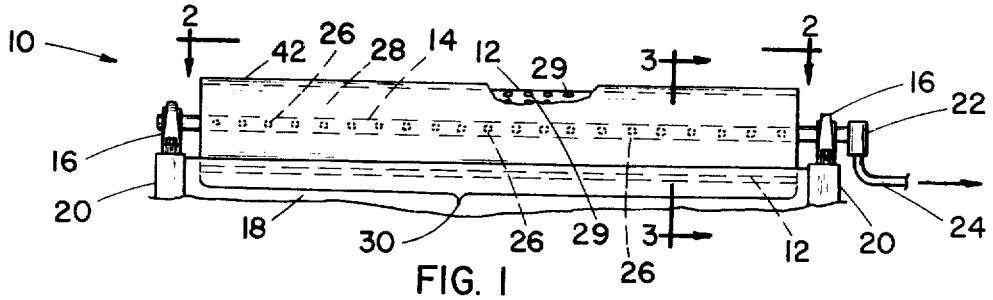
FIG. 1 is a simplified fragmentary front elevation view of an exemplary vacuum cylinder member for a conventional industrial roll type ironing machine showing assembled thereon a reflector, pad, and cover assembly embodying the principles of the present invention.
Figure 3:
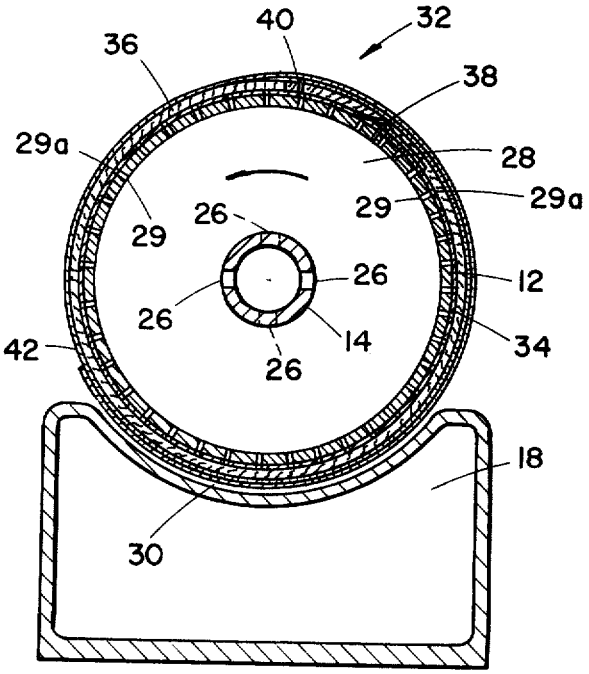
FIG. 3 is an enlarged end elevation of said exemplary vacuum cylinder member as generally seen along the line 3—3 of FIG. 1, wherein is illustrated the assembly thereon of a reflector, pad, and cover means embodying principles of the present invention.
Figure 4:
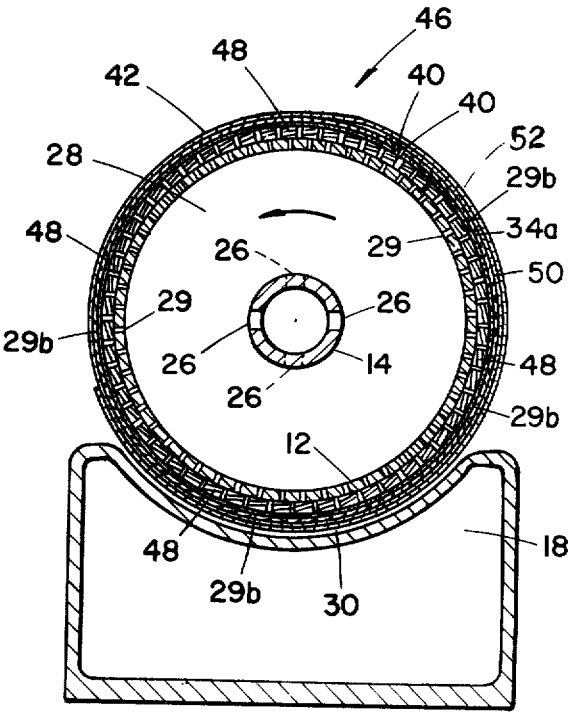
FIG. 4 is an enlarged end elevation of an exemplary vacuum cylinder member similar to that as shown in FIG. 3, but, however, illustrating a modified assembly structure which additionally incorporates spring members within the reflector, pad, and cover means generally embodying principles of the present invention.

Referring to FIG. 1, a simplified fragmentary front elevation assembly view of an exemplary vacuum cylinder unit 10 for a conventional industrial roll type ironing machine is shown, said vacuum cylinder unit 10 being generally comprised of a vacuum cylinder member 12 rotatably assembled by means of a hollow vacuum shaft 14 to bearing members 16 mounted upon the steam chest 18 frame member structure 20 of said machine, said hollow vacuum shaft 14 at one end thereof being rotatably assembled to a rotary coupler 22 connected by conduit 24 to a vacuum pumping means, not shown. The vacuum cylinder member 12, as shown in FIGS. 3 and 4, is rotatably driven in a clockwise direction by conventional gear means, not shown, of the type employed in industrial ironers. It is to be understood that said vacuum cylinder member 12 is hollow and that the longitudinal portion of said vacuum shaft 14, enclosed within said vacuum cylinder member 12, contains a plurality of perforations 26 through which the vacuum means operates within the cylinder chamber 28 through cylinder perforations 29 to produce a reduced pressure environment in the ironing area 30 of said machine. Perforations 29 may be in the form of an overall pattern, or only one or more rows of perforations may be employed, as desired.

Figure 2:
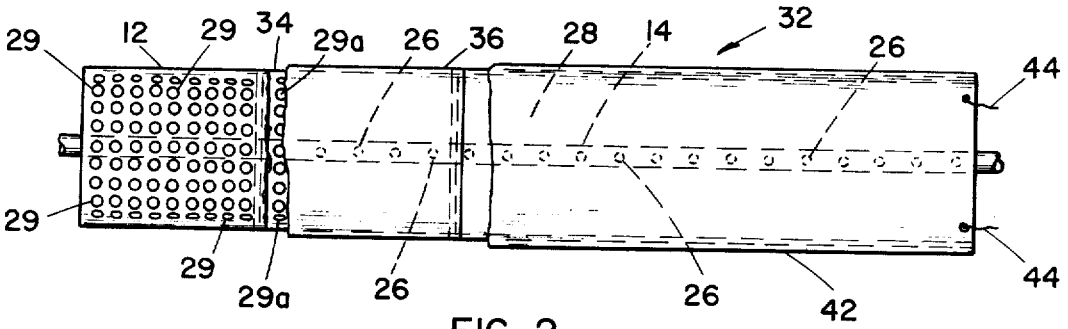
FIG. 2 is an enlarged front elevation of said exemplary vacuum cylinder member as generally seen along the line 2—2 of FIG. 1, additionally showing various cut-away sections of the assembly thereon of a reflector, pad, and cover means embodying principles of the present invention.

Referring to FIG. 2, to explain more fully the components and utilization of the present invention, the same contemplates providing an ironing roll reflector sheet, pad, and cover means assembly 32, which is shown in various cutaway sections as assembled upon a vacuum cylinder member 12 having a plurality of cylinder perforations 29, wherein said cylinder member 12 is affixed along the longitudinal central axis thereof to said hollow vacuum shaft 14 having a plurality of perforations 26 provided therein.

The first component member of said assembly 32 is a sheet of aluminum foil 34 provided with a plurality of perforations 29*a*, at least some of which correspond in pattern to the plurality of cylinder perforations 29, so that it is possible to attach one end of said aluminum foil 34 longitudinally along said vacuum cylinder member 12 and have at least some of the plurality of perforations therein communicate in axial alignment with, and do not obstruct, at least certain perforations 29 and, by means of said aluminum foil 34, provide a heat reflective sheet member directly upon the face of said vacuum cylinder 12. The purpose of said aluminum foil 34 is to further provide an impervious protective shield upon the face of said vacuum cylinder and thereby reduce the corrosive effects of cleaning component-contaminated steam upon the otherwise exposed surface of said vacuum cylinder, as well as providing a highly effective means to reflect heat from the face of said vacuum cylinder 12 back toward the steam chest 18 of said ironing machine, thereby enabling the operational maintenance of the pad member 36 of said assembly 32 in a relatively dry condition and consequently improving overall ironer efficiency.

It should be noted that the preferable method of assembling said aluminum foil 34 to said vacuum cylinder 12 is by means of headed pins or rivets 38, or otherwise, which are illustrated in FIG. 3, which pins perforate said aluminum foil 34 along one longitudinal edge thereof and are thereafter respectively inserted to frictionally engage a longitudinally aligned plurality of regularly spaced openings previously provided in said vacuum cylinder 12 to thereby secure said aluminum foil thereto. Said aluminum foil is then wrapped circumferentially about the longitudinal face of said vacuum cylinder at least one complete revolution in such a manner so that at least some of the perforations in the foil and the perforations in the cylinder are aligned.

The pad member 36, directly overlies reflector sheet 34 and one end preferably is initially stapled or otherwise secured to the end of sheet 34 which is to be attached to cylinder 12. The length of pad 36 is substantially coextensive with that of sheet 34 and said pad is composed selectively, of steel wool, asbestos fibers, resilient and heat-resistant Nylon or Dacron, or otherwise, and possibly is contained between two sheets of wire mesh in order to form a resilient porous pad of sufficient uniform depth to resiliently absorb thickness irregularities in work pieces, such as seams, buttons, and the like during ironing operations, but also be sufficiently porous to permit transmission of vacuum from the cylinder. Said one end of pad member 36 is preferably affixed to cylinder 12 coextensively with said aforementioned end of sheet 34 by either the pins 38 which connect the sheet 34 to cylinder 12 or additional similar pins, said pins 38 being shown in FIGS. 3 and 4. Pad 36 is wrapped around cylinder 12 coextensively with the aluminum foil sheet 34 which is in direct engagement with the exterior surface of vacuum cylinder 12.

The last component of said assembly 32 is a cover member 42, which comprises woven asbestos or other heat-resistant fabric material which preferably is semi-porous so as to be permeable to both air and condensate, thereby enabling the vacuum of cylinder 12 to be effective through said cover member 42 and operate in the ironing area 30 to remove condensate during ironing operations. Said cover member 42 has one end affixed by staples or headed pins 40, of conventional type in the laundry machine art, to the terminal end of said pad member 36, said staple means or pins 40 being illustrated in FIGS. 3 and 4. Said cover member 42 is thereafter wrapped about the sub-assembly structure of reflector sheet 34 and pad member 36 heretofore described, more than one complete revolution, after which the outermost end of said cover member 42 is drawn taut and secured by draw strings 44 or the like such as elastic springs having hooks thereon, of conventional type, in a manner well known in the art.

The materials of fabrication of said assembly 32 preferably are as heretofore indicated, but any other suitable materials of comparable characteristics may be employed.

The view shown in FIG. 3 illustrates an enlarged transverse section of a vacuum cylinder 12 with the assembly 32, comprising the present invention, being assembled thereon circumferentially in the manner heretofore described. Additionally shown in greater detail in FIG. 3 are the respective component parts of said assembly 32 in the overlying relationship thereof.

Referring to FIG. 4, a modified ironing roll reflector, pad and cover means assembly 46 is shown, which assembly additionally incorporates, over the assembly 32 in FIG. 3, the employment of coil spring members 48 in combination with a pad member 50 which is thinner than pad 36 in FIG. 3, to provide the compressive resiliency features necessarily required upon the vacuum cylinder outer circumferential surface in order to absorb work piece irregularities such as seams, buttons, and the like without damage during ironing operations. Said coil spring members 48 are affixed by being spot welded directly to the face of said vacuum cylinder, and as will be noted in FIG. 4, the central open axes of said coil springs are aligned with the perforations 29 in cylinder 12, so as to provide a plurality of unobstructed openings through which the cylinder vacuum may be transmitted.

Prior to installing the thin pad member 50, however, a sheet of heavy aluminum foil 34*a*, having a plurality of perforations 29 therein, is affixed along one end thereof, by wire lace means 52, to a longitudinally aligned row of coil spring members, in such a manner that when said foil 34*a* is circumferentially wrapped about the longitudinal dimension of said vacuum cylinder 12 for at least one revolution, above said coil springs 48, the plurality of perforations 29*b* in said foil 34*a* are likewise in axial alignment with the cylinder perforations 29. The thin pad member 50 is then affixed by staple means to the innermost end of said heavy aluminum foil sheet 34*a* in the manner heretofore described, and thereafter is wrapped circumferentially about the longitudinal dimension of the sub-assembly members for at least one full revolution. The cover member 42 is affixed at one end, such as by staples or pins 40, to the outermost end of said thin pad member 50 as also heretofore described, and then said cover member 42 is thereafter wrapped about the sub-assembly structure, also heretofore described, for more than a single revolution, after which the respective longitudinally disposed circumferential ends of said cover member are secured by spring hooks, not illustrated, but as previously described above relative to FIG. 2 in a manner well known in the art.

It is to be understood that the embodiment of the invention shown in FIGS. 1–3, in particular that the perforated aluminum reflector sheet 34, and pad member 36 are initially connected together at one end and cover member 42 is attached to the outer end of said pad after said sheet 34 and 36 are extended around cylinder 12. The initial ends of the aluminum sheet 34 and pad member 36 are attached to the perforated roll or cylinder 12 by pins 38 and then such assembly is wrapped in coiled fashion around said cylinder for substantially a single convolution, and the cover member 42 then is affixed at one end by pins or staples to the trailing end of pad member 36 and is coiled around pad member 36 more than one convolution, the other end being secured to the coiled assembly 32 by spring hooks 44 or the like.

If desired, the assembly of sheet 34 and pad 36 within confining mesh material may be manufactured, sold and installed in such assembled form, followed by installing cover member 42 at the site of installation upon the cylinder 12. However, it will be seen that only one end of the preliminary assembly of reflector sheet 34 and pad member 36 is attached fixedly to the cylinder 12 in the preferred mode of the invention and the coiled configuration of the entire assembly 32 maintains the same in operative position upon the cylinder, especially as a result of continuous rotation of the cylinder and assembly in operation in the same direction as the coil of the assembly.

While the invention has been described and illustrated in its several preferred embodiments, it should be understood that the invention is not to be limited to the precise details herein illustrated and described since the same may be carried out in other ways falling within the scope of the invention as illustrated and described.

I claim:

1. A porous cover assembly for individual use upon a perforated rotatable vacuum cylinder ironing member of an industrial ironing machine, said porous cover assembly comprising in combination, a sheet of highly reflective metallic sheet material having a plurality of perforations therein and adapted to have one end of said sheet fixedly fastened directly to said vacuum cylinder and thereafter wrapped for at least one full convolution therearound and directly in contact therewith to dispose at least some of the perforations in said reflective metallic sheet in axial alignment with a plurality of vacuum perforations in said vacuum cylinder, a resilient porous compressive pad member, means fastening one end of said compressive pad member to the opposite end of said reflective metallic sheet to constitute a sub-assembly therewith and said compressive pad member being adapted to be wrapped around said reflective metallic sheet for at least one full convolution, a flexible air and steam permeable cover member, and means connecting one end of said permeable cover member to the opposite end of said compressive pad member, said permeable cover member being adapted to be wrapped around said compressive pad member for more than one full convolution, whereby the reduced pressure atmosphere created in said vacuum cylinder may be effective through the perforations therein and through said porous cover assembly to the ironing area of said ironing machine to withdraw by vacuum steam generated during the ironing process and the heat absorbed by the compressive pad and permeable cover members of said porous cover assembly is reflected radially outward therefrom by said sheet of highly reflective metallic material while said compressive pad and permeable cover members remain resilient and porous and free from moisture after ironing use due to the evaporation of condensed moisture therein by said reflected heat.

2. A porous cover assembly according to claim 1 in which said sheet of highly reflective metallic material is moisture impervious aluminum.

3. A porous cover assembly according to claim 1 in which said resilient porous compressive pad member is comprised of a pad having a discrete thickness of corrosion-resistant steel wool contained between an outer covering of closely woven stainless steel wire gauze.

4. A porous cover assembly according to claim 1 in which said permeable cover member is heavy asbestos fabric.

5. A porous cover assembly according to claim 1 in which said resilient compressive pad member is comprised of a combination of a plurality of corrosion-resistant coil springs weldably fastened directly to said vacuum cylinder wherein the central axes of said coil springs are aligned with the central axes of the plurality of vacuum ports in said vacuum cylinder, said sheet of highly reflective metallic material having a plurality of perforations therein being convoluted about said springs at least one time and being compressively held in position upon said springs by said resilient porous compressive pad member which is in turn convoluted about said reflective metallic sheet at least one time.

* * * * *